US005553431A

United States Patent [19]

Pelosi, Jr. et al.

[11] Patent Number: 5,553,431

[45] Date of Patent: Sep. 10, 1996

[54] COVE BASE WITH ANTIMICROBIAL AGENT AND METHOD FOR INSTALLING THE SAME

[76] Inventors: Frank Pelosi, Jr.; Lee J. Pelosi, both of 32 Orchard La., Marlton, N.J. 08053

[21] Appl. No.: 249,795

[22] Filed: May 25, 1994

[51] Int. Cl.[6] ..... E04F 19/04

[52] U.S. Cl. ..... 52/287.1; 52/288.1; 52/272; 52/273; 52/309.5; 52/309.8; 52/717.03; 52/717.05; 52/742.1; 52/745.21; 52/746.1

[58] Field of Search ..... 52/287.1, 288.1, 52/272, 273, 717.05, 717.03, 716.8, 716.2, 716.1, 745.21, 746.1, 742.1, 287.1, 288.1, 309.5, 309.8

[56] References Cited

U.S. PATENT DOCUMENTS

| | | | |
|---|---|---|---|
| 2,541,768 | 2/1951 | Keller . | |
| 3,408,250 | 10/1968 | Finefrock | 52/273 X |
| 3,676,974 | 7/1972 | Daly . | |
| 4,601,149 | 7/1986 | Dokan | 52/287.1 |
| 5,024,840 | 7/1991 | Blakely et al. . | |
| 5,287,667 | 2/1994 | Singhal | 52/716.2 X |

*Primary Examiner*—Carl D. Friedman
*Assistant Examiner*—Christopher Todd Kent
*Attorney, Agent, or Firm*—Norman E. Lehrer; Jeffrey S. Ginsberg

[57] ABSTRACT

The cove base is made from a relatively thin extruded vinyl and has a height dimension which is substantially greater than the thickness. Although the cove base is used as a top set base and covers imperfections in the outer edges of floor tiles or the like, it has the appearance of a straight base in that it does not include a rounded toe. The cove base is wedge shaped in that it is thinner at the top and gradually thickens toward the bottom while the front surface remains substantially planar. A flexible projection which is a continuation of the front surface extends slightly downwardly and conforms to any high or low spots that may be in the flooring. This projection also defines a space behind the projection and beneath the remaining parts of the cove base which may be used to contain a foam strip or caulking material. The cove base, the foam strip and/or the caulking material may include an antimicrobial agent therein.

11 Claims, 2 Drawing Sheets

COVE BASE WITH ANTIMICROBIAL AGENT AND METHOD FOR INSTALLING THE SAME

BACKGROUND OF THE INVENTION

The present invention is directed toward an improved cove base and, more particularly, toward a cove base which is adapted to be secured to a wall base after the installation of a floor covering and which cooperates with the outer edges of the floor covering to give the same a finished look similar to a prehung cove base when installed.

Cove base or coving which is widely used today is comprised essentially of elongated flat strips of extruded vinyl. Conventional cove bases are normally approximately 1/12 to 1/8 inch thick and have a height of 2½ to 6 inches. They are usually available in lengths of 4 feet or in rolls of substantially longer lengths.

There are generally two types of base cove currently available. The first is referred to as a "straight base" or "toeless base" which is essentially a straight piece of vinyl. Straight base coving is normally applied to the wall base prior to the installation of carpeting or other floor covering. As the floor covering is installed, the outer edges thereof must be trimmed substantially perfectly so as to abut evenly against the coving. This can be extremely time consuming and requires the use of skilled labor.

A second type of coving which is currently widely used is referred to as a "top set" cove base. This is similar to the straight base but includes a rounded lip or toe at the bottom thereof which extends forwardly by approximately 3/8 to ½ inch. With top set cove base, the floor tiles or other floor covering material is first installed. The coving is then secured to the base of the walls with the rounded lip at the bottom thereof overlying the edges of the floor covering. Non-perfect or uneven edges of the tiles or other floor covering are, therefore, hidden by the toe of the coving.

The top set cove base does not, however, give the same sharp, clean-cut appearance as the straight base and is, therefore, usually less desirable. Furthermore, care must be taken when installing the top set cove base to ensure that the adhesive which must be applied to the back of the coving does not soil or stain the carpeting. This, of course, is not a problem with the prehung straight base coving since the vinyl coving is adhered to the walls before the floor covering is installed. Top set cove base also conforms to minor waves in the floor leaving a less than straight top edge.

U.S. Pat. No. 5,212,923 discloses a cove base which is prehung and has the clean appearance of a prehung cove base but which functions in a manner similar to a top set cove base. That is, when utilized with carpeting or similar material, the patented cove base can be used to hide the imperfect edges of the carpeting. The patented cove base is wedge shaped in that it tapers gradually from a relatively thin thickness at the top thereof to a thicker thickness at the bottom and includes a forward tip under which the edge of the carpeting can be forced.

While the cove base shown in U.S. Pat. No. 5,212,923 functions extremely well with carpeting, it is believed to be less useful with other types of flooring such as tiles and the like. Tiles are, of course, not flexible. Accordingly, the patented cove base cannot be prehung since it is not possible to flex the tiles in order to force them under the tip of the coving. When used as a "top set" cove base, the patented coving has utility with more rigid types of floor covering.

However, the forward tip of the patented coving is relatively rigid and cannot, therefore, always follow any imperfections in the flooring.

When the patented coving is used as a top set with more rigid floorings, the failure of the forward tip to follow imperfections in the floor can result in a less than perfect appearance since gaps may be visible between the coving and the flooring. This can be even more significant in installations such as hospitals and the like which must be kept antiseptic. When the floor is being washed, waste water and debris or the like can pass under the gaps and accumulate in the space between the tip of the coving and the wall where bacteria or other microorganisms can grow.

SUMMARY OF THE INVENTION

The cove base of the present invention is designed to overcome all of the deficiencies of the prior art described above and to combine the advantages of all of the types of prior coving now available. The new cove base has a wedge shape very similar to that disclosed in prior U.S. Pat. No. 5,212,923. However, it is not intended to be prehung and, accordingly, does not require the use of the gauging portion shown in the patent. Furthermore, in lieu of the relatively rigid forward tip of the patented coving, the coving of the present invention provides a very small and relatively flexible downward projection which can more easily follow the contours of a floor. The plastic from which the cove base is made may include an antimicrobial agent therein. A bead of caulking material with or without an antimicrobial agent therein can be applied to the crease between the floor and the wall before the coving is put in place in order to seal the bottom thereof. In a further embodiment, after the coving is installed, the flat nozzle of a caulking gun can be forced under the forward lip of the coving and caulking material can be injected into the space behind the lip as the caulking gun is moved the length of the wall.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 3:
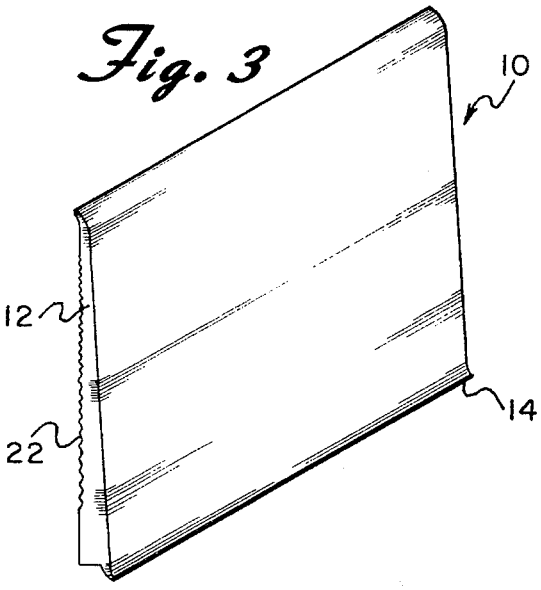
FIG. 3 is a front perspective view of a length of the cove base.
Figure 4:
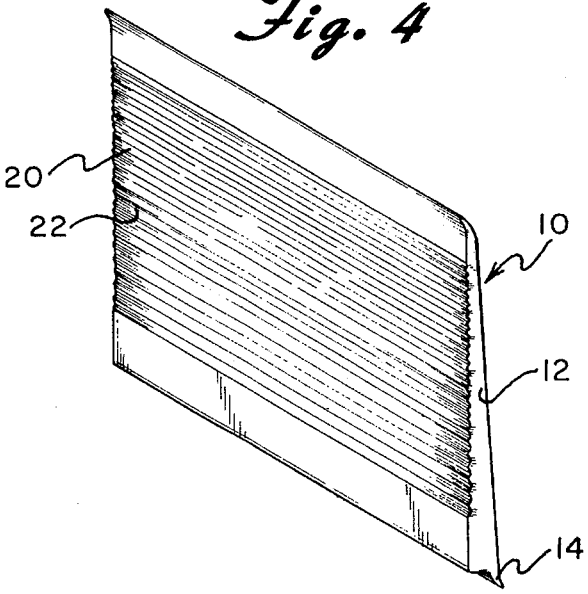
FIG. 4 is a rear perspective view thereof.

Referring now to the drawings in detail wherein like reference numerals have been used throughout the various figures to designate like elements, there is shown in FIGS. 3 and 4 a length of cove base constructed in accordance with the principles of the present invention and designated generally as 10. FIG. 3 shows the front of the cove base while FIG. 4 shows the same from the rear thereof. While, in each figure, the cove base is shown as having a fixed length, it may be of substantially any length. Thus, the cove base of the present invention could be sold in 4-foot lengths or lengths of substantially any size. Furthermore, since the preferred material from which the cove base is made is extruded vinyl which is somewhat flexible, the cove base could be available in extremely long lengths and can then be rolled for shipping and handling.

The cove base 10 is comprised essentially of an upper portion 12 and a lower portion comprised of a downwardly directed flexible projection 14. Located between these two portions is a transition zone which is comprised essentially of a bottom wall 16 at the lower part of the upper section 12. As shown most clearly in FIGS. 2 and 6–8, the bottom wall 16 is substantially horizontally disposed. That is, wall 16 is substantially perpendicular to the plane of the major portion of the cove base 10.

The upper portion of the cove base 10 has an appearance which somewhat resembles a standard straight base type of coving and is substantially similar to the upper portion of the prehung gauged cove base shown in U.S. Pat. No. 5,212,923. This upper portion 12 may be from 3 to 5 inches high and has a finished front surface 18. The upper portion 12 has a thickness of approximately ⅛ to ¼ inch. In the preferred embodiment, the upper portion tapers slightly from the top to the bottom, as shown, whereby it is somewhat thicker near the bottom or lower portion than at the top thereof. The top has a thickness of approximately 1/12 inch which tapers to a thickness of approximately ¼ inch. As can be best seen in FIG. 2, substantially the entire area of the front surface 18, from adjacent the top thereof to the very bottom including the downward projection 14, is planar. That is, it lies in a single plane and is not substantially curved at the bottom thereof, thereby more closely resembling a "straight base" cove rather than a curved "top set" cove base.

The rear surface 20 of the cove base 10 is also planar and substantially continuous between substantially the very top thereof to the very bottom. However, and as is well known in the art, the rear surface 20 preferably has a plurality of grooves 22 formed therein so that adhesive 24 used to secure the cove base 10 to a wall base will adhere more tightly thereto.

Figure 1:
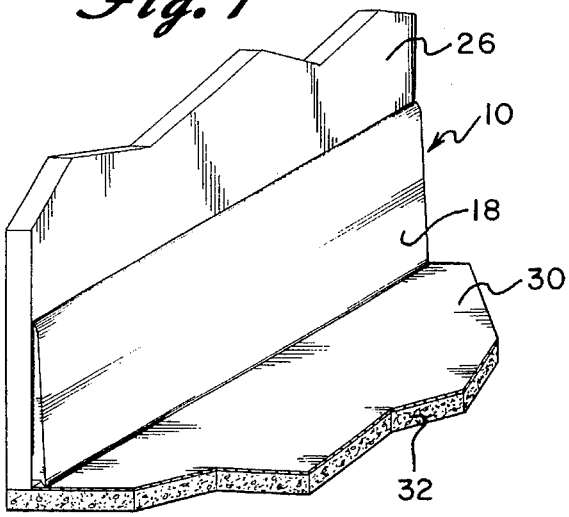
FIG. 1 is a perspective view of the cove base constructed in accordance with the principles of the present invention and applied to the base of a wall after the floor covering has been installed.
Figure 2:
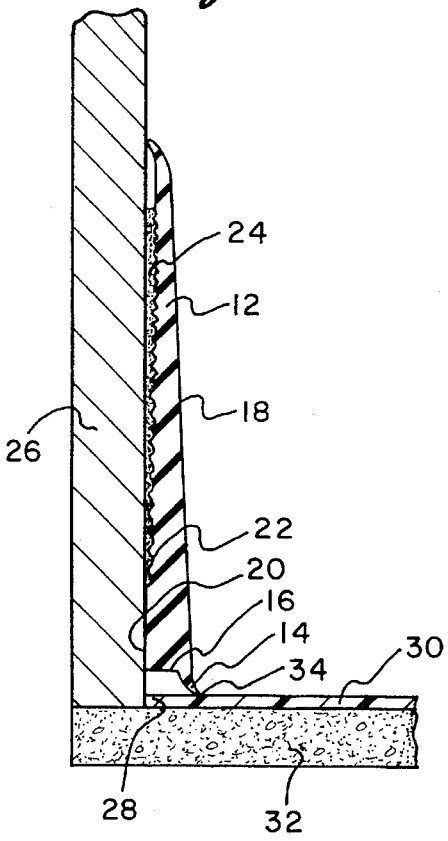
FIG. 2 is a cross-sectional view taken through the line 2—2 of FIG. 1.
Figure 9:
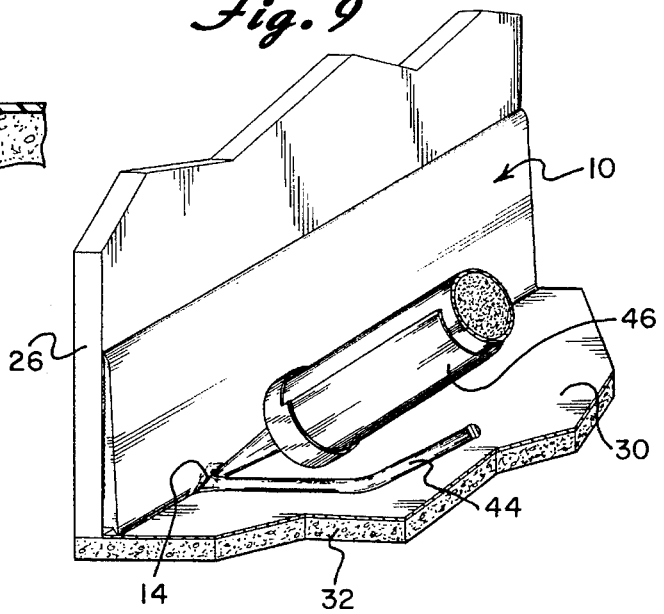
FIG. 9 is a perspective view illustrating an alternative installation method.

Although both the front wall 18 and the rear wall 20 are planar, they are not parallel with each other. Rather, and as can clearly be seen in the figures, these walls essentially intersect adjacent the top of the cove base 10 and are further apart from each other adjacent the bottom thereof. The cove base 10 is, in essence, a wedge shape. As a result of this wedge shape and as can be best seen in FIGS. 2, 6 and 8, when the cove base 10 is applied to the wall 26, the bottom of the cove base extends forwardly to hide any imperfections in the outer edge 28 of the floor tile 30 or the like placed on the floor 32. Although the cove base 10 is essentially wedge shaped and tapers from the top to the bottom, this taper is so gradual that it is hardly noticeable when the cove base is installed so that the same gives the appearance of a "straight base" as shown in FIGS. 1 and 9.

When the floor tiles 30 or other types of flooring are installed, there sometimes may be high or low spots adjacent the edges thereof which would prevent a standard cove base from forming a tight fit or seal therewith. That is, there may be gaps or openings between the flooring 30 and the bottom of the cove base. In order to reduce this possibility, the cove base 10 of the present invention includes the lower projection 14. This projection 14 is essentially a downward extension of the front wall 18. The height of the projection 14 from the bottom wall 16 to the lowermost tip 34 is approximately ⅛ to 3/16 inches. It preferably is also very thin having a thickness of only approximately 0.05 inches.

It is preferable that the front surface of the projection 14 lie substantially in the same plane as the front surface 18 so that the same has a substantially planar appearance. However, it is possible to curve the lower projection 14 slightly forwardly since it is extremely small and would, therefore, not interfere with the planar appearance of the cove base. In either case, the lowermost tip 34 of the projection 14 preferably points substantially downwardly in order to engage the flooring 30. While the downward projection 14 is made of the same material as the remaining portions of the cove base 10, since the same is preferably extruded as a single piece, because of its shape, it is substantially more flexible than the remaining portions of the cove base. Accordingly, any imperfections in the flooring will be taken up by the downward projection 14 since the same can flex in order to accommodate high spots and the like.

In order to help seal the cove base to the floor, an elongated block of resilient foam such as urethane or the like 36 can be secured to the bottom wall 16. The foam 36 lies essentially in the hollow space behind the projection 14 and below the wall 16. The foam normally has a height which is slightly less than the height of the projection 14. The lower surface 38 of the foam 36 has a pressure adhesive formed thereon which is normally covered by a release paper 40.

Figure 5:
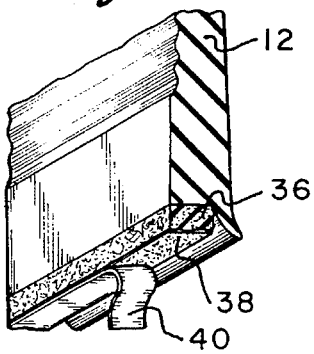
FIG. 5 is a partial cross section and rear perspective view of a portion of a modified form of the cove base.
Figure 6:
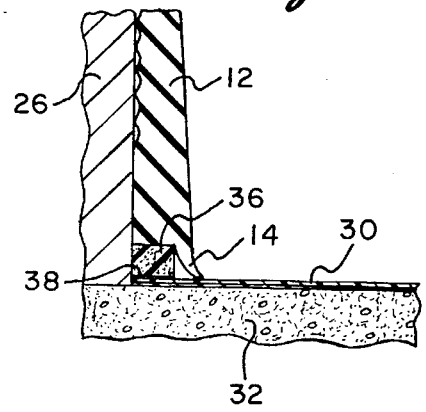
FIG. 6 is a cross-sectional view similar to FIG. 2 but showing the modified form of the invention of FIG. 5.
Figure 7:
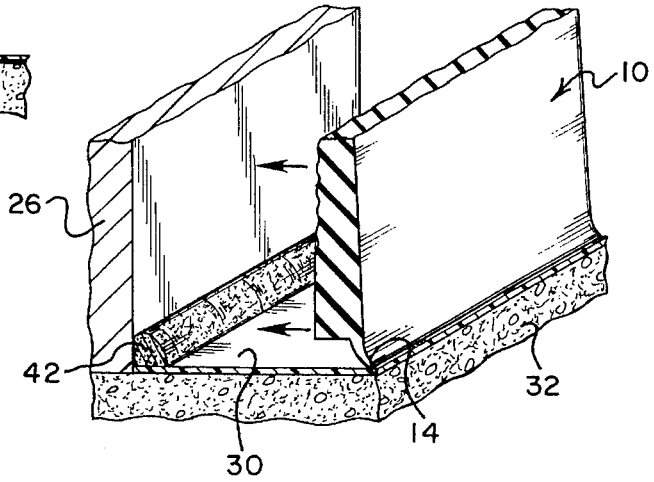
FIG. 7 is an exploded view illustrating one method of installing the cove base of the present invention.
Figure 8:
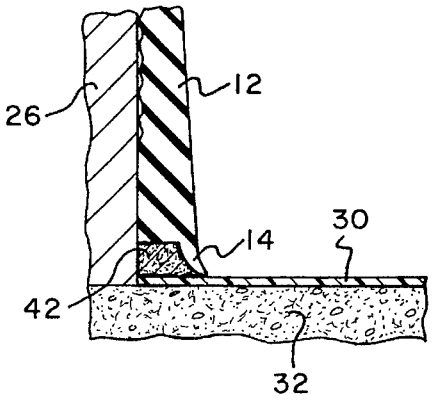
FIG. 8 is a cross-sectional view showing the cove base installed in accordance with the method shown in FIG. 7.

When utilizing the embodiment of the invention with the foam which is shown in FIGS. 5 and 6, the adhesive or cement 24 is applied to the back of the base cove 10 and the release paper 40 is removed from the bottom of the foam 36. The base cove 10 is then put into place and forced downwardly until the adhesive 38 at the bottom of the foam 36 affixes itself to the floor 30. When this is being done, the projection 14 flexes slightly in order to allow the foam 36 to contact the floor 30. Thereafter, the foam 36 will stretch in height as the projection 14 resumes its normal position and the foam 36 will tend to hold the cove base in place while the adhesive 24 is drying.

The present invention also provides a means for establishing a fluid-tight seal between the bottom of the cove base and the floor. As shown best in FIGS. 7 and 8, this is accomplished by first placing a bead 42 of caulking material or the like into the crease formed between the wall 26 and the floor 30. Thereafter, and while the caulking material 42 is still uncured, the cove base 10 is put into place in the normal manner and, as can best be seen in FIG. 8, the caulking material 42 fills the entire space formed behind the projection 14 and beneath the wall 16.

In lieu of first placing a bead of caulking into the crease, it is also possible to fill the space behind the projection with caulking after the cove base 10 has been installed. Since the projection 14 is somewhat flexible, it is possible to pry the same upwardly with a tool 44 such as shown in FIG. 9 so that the nozzle of a caulking gun 46 can be inserted into the open space. The tool 44 and caulking gun 46 can then be moved longitudinally as the caulking material is injected into the space. In lieu of the tool 44, it may also be possible to shape the nozzle of the caulking gun 46 so that it will act as the tool to flex the projection 14 out of the way as the caulking material is being injected.

As is well known in the art, many installations of cove base are in hospitals or the like which require aseptic conditions. However, when the floors are being washed, it is not uncommon for waste water which may include food or other organic materials to seep under the front edge of the cove base. As a result, bacteria and other microorganisms can then grow in the crease behind the cove base.

In order to overcome this problem, the present invention also contemplates the use of an antimicrobial agent carried by or associated with the cove base 10. This can be accomplished in several ways. First, the antimicrobial agent can be incorporated directly into the material from which the cove base is made. Over an extended period of time, the antimicrobial agent will be slowly released from the cove base to effectively kill bacteria or other microbes that may start to grow. Similarly, the antimicrobial agent could be incorporated into the foam 36 or into the caulking material 42. A suitable antimicrobial agent is a material sold under the name INTERSEPT available through Interface, Inc., of La Grange, Ga. Other antimicrobial materials that may also be useful are described in U.S. Pat. Nos. 5,024,840 and 5,292,763.

The present invention may be embodied in other specific forms without departing from the spirit or essential attributes thereof and accordingly reference should be made to the appended claims rather than to the foregoing specification as indicating the scope of the invention.

We claim:

1. A cove base adapted to be secured to a wall base and to cooperate with the outer edges of a floor covering to give the floor covering a finished look when installed, said cove base comprising: an elongated substantially flat member having a height dimension which is substantially greater than the thickness thereof and including an antimicrobial agent carried by said member, said antimicrobial agent being capable of being slowly released from said member over an extended period of time.

2. The invention as claimed in claim 1 wherein said antimicrobial agent is incorporated into the material of which the member is comprised.

3. The invention as claimed in claim 1 wherein said member has a top and a bottom and further including resilient foam secured to said bottom and extending substantially the entire length of said member, said antimicrobial agent being carried by said foam.

4. A cove base adapted to be secured to a wall base and to cooperate with the outer edges of a floor covering to give the floor covering a finished look when installed, said cove base comprising: an elongated substantially flat member having a height dimension which is substantially greater than the thickness thereof said member having a top, a bottom, a substantially planar front wall, and a rear wall, said rear and front walls gradually tapering away from each other beginning adjacent the top thereof and continuing downwardly throughout substantially the entire height of said member whereby said member is thinnest adjacent the top and gradually becomes thicker toward the bottom; the bottom of said member adjacent the rear thereof including a bottom wall and having resilient foam secured thereto; the bottom of said member adjacent the front wall including a substantially downwardly directed flexible projection having a front which is substantially a continuation of said front wall, said projection extending below the level of said bottom wall to thereby form a hollow space behind said projection.

5. The invention as claimed in claim 4 wherein said foam is compressible in the vertical direction and the height of said foam before it is compressed is less than the height of said projection.

6. The invention as claimed in claim 4 further including pressure adhesive means on the underside of said foam.

7. The invention as claimed in claim 4 further including an antimicrobial agent carried by said member.

8. A method of installing a cove base to the intersection between a room wall and floor wherein said cove base has a planar front wall having a lower edge and a planar and vertically extending rear wall in which the front wall extends downwardly below the rear wall so as to form a hollow space behind the lower edge of said front wall, said method comprising: contacting said rear wall to said room wall throughout substantially the entire height of said rear wall and, thereafter, providing a bead of caulking material into the intersection between the room wall and the floor, the amount of said caulking material being sufficient to substantially fill said space.

9. The method as claimed in claim 8 wherein said caulking is applied by flexing the lowermost portion of the front wall and injecting the caulking into said space.

10. The method as claimed in claim 8 wherein said caulking material includes an antimicrobial agent therein.

11. A cove base adapted to be secured to a wall base and to cooperate with the outer edges of a floor covering to give the floor covering a finished look when installed, said cove base comprising: an elongated substantially flat member including an antimicrobial agent carried thereby, said member having a height dimension which is substantially greater than the thickness thereof said member having a top, a bottom, a substantially planar front wall, and a rear wall, said rear and front walls gradually tapering away from each other beginning adjacent the top thereof and continuing downwardly throughout substantially the entire height of said member whereby said member is thinnest adjacent the top and gradually becomes thicker toward the bottom; the bottom of said member adjacent the rear thereof including a bottom wall; the bottom of said member adjacent the front wall including a substantially downwardly directed flexible projection, said projection extending below the level of said bottom wall to thereby form a hollow space behind said projection.

* * * * *